United States Patent [19]

Hill

[11] 4,022,519

[45] May 10, 1977

[54] HEAT RECOVERABLE CONNECTION

[75] Inventor: Frederick William Leslie Hill, Lechlade, England

[73] Assignee: Raychem Limited, London, England

[22] Filed: May 14, 1975

[21] Appl. No.: 577,461

[30] Foreign Application Priority Data

May 14, 1974 United Kingdom ..... 21369/74

[52] U.S. Cl. ..... 339/30; 339/DIG. 1

[51] Int. Cl.[2] ..... H01R 13/20

[58] Field of Search ..... 339/30, 276, DIG. 1; 174/84 C, DIG. 8

[56] References Cited

UNITED STATES PATENTS

| | | | |
|---|---|---|---|
| 3,174,851 | 3/1965 | Buehler et al. | 339/DIG. 1 |
| 3,538,240 | 11/1970 | Sherlock | 339/DIG. 1 |
| 3,622,941 | 11/1971 | Wetmore | 339/98 |
| 3,708,611 | 1/1973 | Dinger | 174/DIG. 8 |
| 3,740,839 | 6/1973 | Otte et al. | 339/DIG. 1 |
| 3,861,030 | 1/1975 | Otte et al. | 339/30 |

*Primary Examiner*—Joseph H. McGlynn
*Attorney, Agent, or Firm*—Lyon & Lyon

[57] ABSTRACT

Described herein is a reusable connector which may, for example, find use in making electrical connections. The connector comprises a heat recoverable metallic band disposed about a non-resilient, deformable member, typically a hollow cylinder that has been slotted to form tines, that has been deformed from an original configuration. When it is desired to make a connection, an object member is inserted into the deformable member and the metallic band is caused to shrink and drive the deformable member towards its original configuration thereby engaging the object member. Preferably the object member has an enlarged portion that is positioned so that when the object member is inserted, the enlarged portion passes through the metallic band. Recovery of the metallic band behind the enlarged portion inhibits withdrawal of the object member from the connector. The connector is reusable in that when the temperature of the band is reduced to cause it to revert to its martensitic state, the object member can be removed from the connector. If the object member has an enlarged portion, it will re-expand the deformable member and the recoverable member during withdrawal.

10 Claims, 9 Drawing Figures

HEAT RECOVERABLE CONNECTION

FIELD OF THE INVENTION

This invention relates to connectors having a heat recoverable member. In another respect, this invention relates to connectors, especially for making electrical connections and terminations.

BACKGROUND OF THE INVENTION

The field of electrical connection and termination has, until recently, largely depended upon traditional methods such as soldering and crimping to effect the connection and termination of, for example, conductors and cable screens. In simple applications both of these traditional methods are quite satisfactory, but there are many other applications, for example, when the connection or termination must be made in a cramped environment or when one or more associated components are fragile or vulnerable to heat, when a highly skilled operator is needed to obtain successful results.

More recently, it has been proposed to utilize the properties of so-called "memory metals" (sometimes called heat-recoverable metals) to form connections. Such memory metals and their properties are described, for example, in British Pat. Nos. 1,202,404; 1,327,441; 1,327,442 and 1,338,278 and in U.S. Pat. Nos. 3,174,851 and 3,351,463. Basically, these memory metals are alloys which are capable, like certain plastics materials, of having the property of heat recoverability imparted to them by virtue of their different properties in their martensitic (low temperature) and austenitic (high temperature) states. Thus an article made from such a memory metal can easily be deformed while in the martensitic state to a heat-unstable configuration in which it will remain while kept in the martensitic state. When it is warmed through the transition temperature, (which, in practice, is usually a small temperature range) to the austenitic state, however, it will recover towards its original form.

As disclosed in British Pat. No. 1,327,441, such memory metals can be used to form useful heat-shrinkable connecting members, especially tubular connecting members with inner teeth.

As disclosed in British Pat. No. 1,327,442, some of the recovery can be made reversible by imparting further secondary or non-thermally recoverable deformation to the article. Thus when a heat-shrunk memory metal connector is once again cooled to its martensitic state a small degree of re-expansion may occur. However, the degree of re-expansion is generally rather small (i.e. not greater than 3% compared to a recovery of about 8%) and, in some applications, is not sufficient on its own to facilitate removal and reuse of the connector.

In U.S. Pat. No. 3,740,839 there is described and claimed a reusable connector comprising a heat-recoverable metal member (e.g. a band) in conjunction with a resisient connecting member (e.g. a longtiudinally slotted cylindrical element positioned inside the band). When the temperature is above the transition temperature the recovery force of the recoverable metal band dominates and a connection is made on to an underlying object. When, on the other hand, the band is cooled to its weaker martensitic state, the resilient forces of the times of the connecting member are dominant and the band is forced to expand, thus releasing any connection which has been made. In an alternative form of connector the heat-recoverable metal member may be employed to force the tines of the resilient connecting member apart on recovery, thus enabling a different type of connection to be made (or broken) at the higher temperature. The connector described and claimed in U.S. Pat. No. 3,740,839 has wide application and has proved very successful in solving several different types of problems traditionally encountered in the general field of connection and termination but there are nevertheless some applications where its use is not suitable.

One example of a situation in which the use of a connector as described and claimed in U.S. Pat. No. 3,740,839 may not always be suitable is when the requirements of the connection or termination are such that no resilient connector member could be used because the resilience of the member could not be accommodated by other components associated with the connection. Another example is when the other requirements of the metal of the connector, such as coefficient of thermal expansion, thermo-electric properties and solderability, are not compatible with the necessary degree of resilience. Yet another disadvantage to the connector with a resilient member is that disengagement of the connector is more likely if the connector is temporarily exposed to a temperature at which the recoverable member reverts to its martensitic form.

SUMMARY OF THE INVENTION

It is an object of this invention to provide a reusable connector having a heat recoverable member.

It is another object of this invention to provide a reusable heat recoverable connector not requiring a resilient member to re-expand the heat recoverable member.

The present invention provides a reusable connector which comprises: a first member at least part of which is substantially non-resilient and deformable; a second, heat recoverable member made from a memory metal, the arrangement of said deformable member and recoverable member being such that at a temperature below the transition temperature of the memory metal the non-resilient deformable part of the first member and the second member can be deformed from their existing configuration so that when the connector is then raised to a temperature above the transition temperature, the recovery of the second member towards its original configuration will force the deformable part of the first connector member back towards its original configuration.

DETAILED DESCRIPTION OF THE INVENTION

Figure 1:
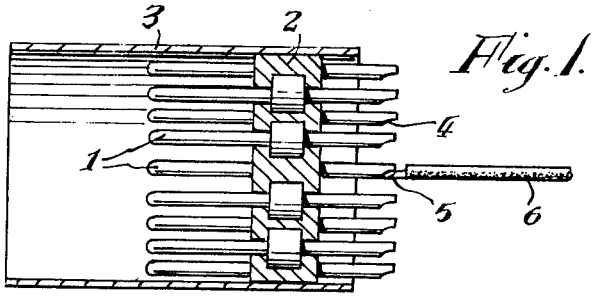
FIG. 1 illustrates in cross-section a standard connector.

The present invention provides a method for making a connection between two substrates by means of a novel reusable connector. The invention is especially suited to the making of electrical connections in which case the substrates to be joined typically are electrically conducting members.

The novel connector comprises: a first member at least part of which is non-resilient and deformable and a second heat recoverable member made from a memory metal of the type described above, the arrangement of these members being such that at a temperature below the temperature at which the memory metal exists in its martensitic state, the non-resilient, deformable part of the first member and the second member can be deformed from their original configuration so that when the connector is subsequently raised to a temperature at which the recoverable member reverts to its austenitic state, the recovery force deforms the deformable member towards its original configuration, and into close engagement with an object member, adapted to be inserted into the deformable member, preferably having an enlarged portion that engages the deformable member and heat recoverable member, after recovery of the latter, to prevent its withdrawal from the connector.

The object member provides the terminal end of one of the substrates to be joined. The deformable member terminates the other substrate. To disconnect the substrates, the heat recoverable member is cooled to the temperature at which it exists in its martensitic state, a state in which it is easily deformed, and the substrates physically pulled apart. In this operation, the enlarged portion of the object member re-expands the deformable member and heat recoverable member, thereby facilitating disengagement and restoring the configuration of the connector members for subsequent reuse. The recoverable member can be maintained in its enlarged condition by being kept below the temperature at which it exists in a martensitic form or by providing it with a rigid keeper to prevent its recovery when warmed above its transition temperature.

In the process of making the connection, the object member is inserted into the non-resilient deformable member and the connector warmed to allow the heat recoverable member to recover. The recovery force causes the deformable member to securely engage the object member.

By "substantially non-resilient" there is herein meant that the deformable member (unlike the resilient member described in U.S. Pat. No. 3,740,839) is not sufficiently resilient that when the recoverable member is cooled below the temperature at which its transition to martensite occurs, it will by its own resilience deform the recoverable member.

In some cases it will be advantageous to cool the deformable member and recoverable member below the transition temperature of the latter and deform them while at that temperature by simply forcing them over the enlarged portion of the object member. When the recoverable member subsequently warms above the temperature, it will attempt to revert to its original shape thereby forcing the deformable member into close contact with the object member.

However when the object member is small, for example when it is a small pin made from nickel/iron alloy, it may be difficult to dimension it with sufficient accuracy that itself can be used to deform the members of the reusable connector particularly since it is to be manufactured with a bulge or other radial protuberance. In other cases, the object member may be relatively inaccessible or associated with fragile components or itself be too fragile for the initial deformation. Accordingly, in general it will be more convenient to deform the deformable and heat recoverable members by using a separate mandrel or other similar means which is generally sized to conform with the dimensions of the object member. In such cases, the deformable member and recoverable member, while the latter is in its martensitic state, may be expanded with a mandrel, e.g. a pin having a tapered end, and then immediately be positioned about the object member before the temperature of the connector has risen above that at which the recoverable member reverts to austenite with the accompanying dimensional change.

It is also possible to expand the deformable member and recoverable member at the time of their manufacture or assembly or at some time prior to completing the connection and then provide them with a keeper, for example a temporary mandrel (which may in some cases be the mandrel used for deformation) to prevent recovery. Preferably, the keeper has dimensions slightly larger than the enlarged portion of the object member over which the members of the connector must pass. The members with the keeper in position can then be stored at room temperature. Prior to installation, this particular assembly can again be cooled below the transition temperature, whereupon its grip upon the keeper will be slackened allowing its removal, whereupon the connector is quickly placed in position about the object member before the recoverable member warms above the transition temperature.

In a preferred form of connector according to the present invention, the deformable member comprises a longitudinally slotted tubular portion having a plurality of tines, preferably at least two tines. It is also preferable that at least the tines be substantially non-resilient and deformable. The heat recoverable member is preferably a band, more preferably a continuous ring, positioned around the tines. Because (contrary to the arrangement in the resilient connector described in U.S. Pat. No. 3,740,839) there is substantially no interaction between the tines and the band, it may be preferable to provide the deformable member with means, e.g. a peripheral shoulder, for properly positioning the band on said member.

The object member, e.g. a connector pin, can be forced into the deformable member while the heat recoverable member is in its low temperature state, forcing the tines outwardly and expanding the metal band. When the temperature is then raised above the transition temperature the heat-recoverable band recovers and forces the deformable tines around and into firm connection with the object member.

The object member preferably has a portion of slightly greater size, e.g. of greater outer diameter. For example, a connector pin may be provided with a small bulge along its length or may be slightly tapered away from its end. This serves two purposes. First of all, upon recovery, the pullout strength of the connection made will be increased, especially if the heat-recoverable metal member has shrunk over a smaller sized portion of the object and must be pulled over the larger sized portion, e.g. the bulge, before the connection can be broken. Secondly, when it is desired intentionally to break the connection for modification or repair purposes and the connection is cooled again to a temperature below the transition temperature of the memory metal, the portion of larger size will deform the connector as it passes over it and thereby facilitate subsequent disconnection. In the case where the heat-recoverable metal member must be passed over this portion to break the connection it will be deformed in its low temperature state and will thus again be capable of heat-recovery. This may obviate the need for further expansion, e.g. by a mandrel, before the connector is replaced or otherwise reused. It will be appreciated that in some cases it may be convenient to obtain a similar effect by providing the deformable member e.g. the tines, with an inner protuberance, e.g. and annular bulge, which cooperates with a recess, e.g. an annular groove, in the object, e.g. the connector pin.

The connectors according to the present invention may be provided with other means for making connections. For example, a connector as described above may be provided with a band and tines at one end for making contact with a connector pin, in accordance with the present invention, and may be provided at its other end with means for connecting a conductor wire or another connector pin. Such means may, for example, simply comprise another deformable portion which can be crimped to the wire or pin. Alternatively, it may comprise a solder pot for a soldered connection. It will be appreciated, of course, that the connectors according to the present invention may comprise more than one heat-recoverable metal member, e.g. that the same type of connection may be made at both ends of the conductor.

Because the tines are non-resilient the connector can be made slimmer than, for example, a connector as described in U.S. Pat. No. 3,740,839. This is a considerable advantage in many applications.

The memory metals used in the connectors of the present invention may, for example, be chosen from those disclosed in the above-mentioned patents. The particular memory metal chosen will depend on the field of application of the connector, especially with regard to its transition temperature. To avoid the connection made being accidentally broken it is important that the transition temperature of the memory metal lies below the lowest temperature likely to be encountered. In many applications, the connector will be required to operate at temperatures from −40° C upwards, perhaps as low as −75° C, and suitable alloys for such use are those containing approximately equiatomic proportions of titanium and nickel optionally with small proportions of other metals. The connectors may readily be lowered to their transition temperature by spraying with liquid nitrogen or by using commercially available cooling tools. Other useful alloys are disclosed in U.S. Pat. No. 3,783,037, the disclosure of which is incorporated by reference.

The deformable member will, in general, be made from a metal and amongst especially suitable metals there may be mentioned the thermocouple metals, chromel and alumel.

One form of connector in accordance with the present invention will now be described, by way of example only, with reference to the accompanying drawings.

Referring to the accompanying drawings, there is shown in FIG. 1 a standard circular military connector of an early type comprising a plurality of pins or sockets 1 embedded in an insulating plastics moulded block 2, which is in turn mounted within an outer metal shell 3 which provides the necessary alignment for correct mating and the locking means necessary to hold the connection together under conditions of vibration. Each pin or socket 1 is provided with a solder pot 4 for making a soft solder connection to a wire 6. The pins or socket member 1 are fixed within the insulator block 2 and the connection of the wires 6 is limited to some extent by the accessibility of the solder pots 4.

Figure 2:
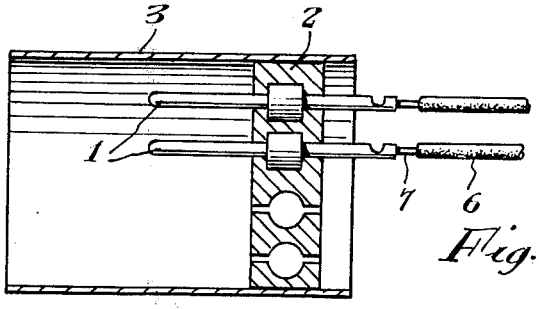
FIG. 2 illustrates in cross-section another standard connector.

Referring now to FIG. 2, this shows a modified form of circular connector in which the pins or socket members 1 are removably mounted within a resilient insulating block 2 of rubber or a similar material. This has the great advantage that the pins or sockets 1 can form a crimped connection 7 with the wires 6 and then be inserted into the block 2.

Figure 4:
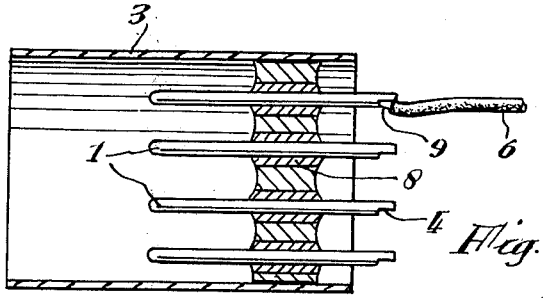
FIG. 4 illustrates another standard connector.
Figure 3:
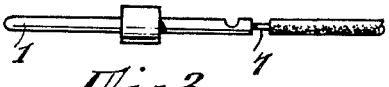
FIG. 3 shows the crimped connection of a wire to a connector pin for use with the connector of FIG. 2.

However, the use of demountable pins or sockets is not always possible and one type of circular connector which still utilizes fixed pins or sockets 1 is shown in FIG. 4. This is a hermetically sealed high temperature connector where the pins 1 are fixed within the metal shell 3 by glass-to-metal seals 8.

This type of connector is very expensive and is often made with its pins or sockets 1 made from thermocouple metals so that it can be used in the temperature sensing systems found in aircraft engines and nuclear power installations. To date no satisfactory method of forming a crimped connection to such a connector has been found and, as the high service temperature of this type of connector precludes soft soldering, it has been necessary to employ silver soldering or brazing necessitating the use of a jeweller's blowpipe. Apart from the problems of accessibility, such operations require high skill and much care is required to avoid damaging heat-sensitive components, such as wire insulation.

One typical application requiring the use of a hermetically sealed connector is the thermocouple system used for temperature sensing on an aircraft gas turbine engine. Insulated wires leading from the thermocouple elements themselves (these wires comprising stranded conductors made from thermocouple metals) are joined to a connector mounted on a pressure-proof bulkhead at the point where the wiring leaves the unpressurized engine area and enters the pressurized cabin area of the aircraft. The mating half of the connector is joined to a similar group of wires, also having thermocouple metal conductors, leading away to the instrumentation, where the electrical signals, representing temperature, are processed for engine control purposes. The pins and sockets in the two connector halves are themselves made of the same thermocouple metals, for example, chromel and alumel, which are not springy. The conditions met in this application fix the characteristics of the inter-connection system as follows:

1. The electrical circuit must be in thermocouple metal throughout.
2. The connections must be vibration proof.
3. The method of attaching the wires to the rear ends of the connector pins/sockets must be compact enough to fit within the pin spacings of the connector.

4. The method of attachment and removal of the wires should not involve the use of a flame or require a great deal of skill.

FIGS. 5 to 9 of the drawings show how, with a modified form of hermetically sealed military connector, the present invention provides a simple and relatively inexpensive method of making a demountable connection suitable for this purpose.

Figure 5:
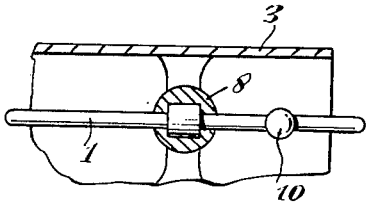
FIG. 5 shows a modification of the connector pin of FIG. 4 useful in the present invention.
Figure 6:
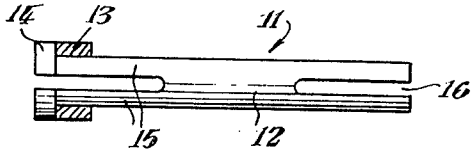
FIG. 6 shows, in cross-section a connector according to the present invention.
Figure 7:
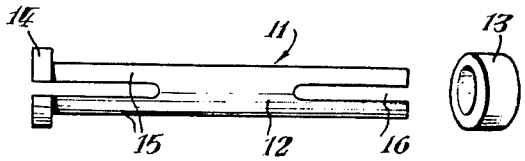
FIG. 7 is an exploded view of the connector of FIG. 6.

FIG. 5 shows a modified form a hermetically sealed military connector wherein the pins or sockets 1 have, at their rear ends, a pin with or enlarged portion, a small bulge or radial protuberance, 10 in place of a solder pot. FIGS. 6 and 7 show a connector 11 in accordance with the present invention comprising a non-resilient, deformable member 12 and an associated memory metal ring 13. The deformable member 12 is provided with a shoulder 14 for positioning the ring 13 and is slotted longitudinally at this end to form two non-resilient tines 15. At its rear end it is provided with a slot or aperture 16 for forming a crimped connection with a wire 6.

Figure 8:
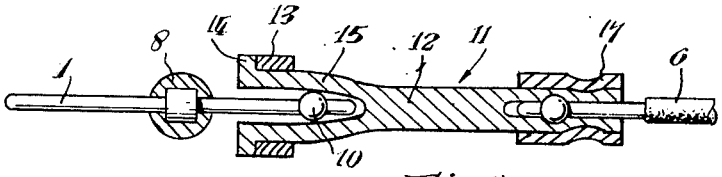
FIG. 8 shows the use of the connector of FIG. 6 in making a connection with the connector pin of FIG. 5.

FIG. 8 shows the making of the connection. The connector 11 has been cooled to its low temperature form and has been forced over the protuberance 10 in the rear end of pin or socket 1 causing it to expand as shown. (However, as discussed above, it will, in many cases be preferable to deform the connector 11 by using a suitably sized mandrel). The wire 6 has previously been crimped to the other end of the connector 11 and, for this purpose, a separate crimping ferrule 17, made, for example, from copper, may have been utilized.

Figure 9:
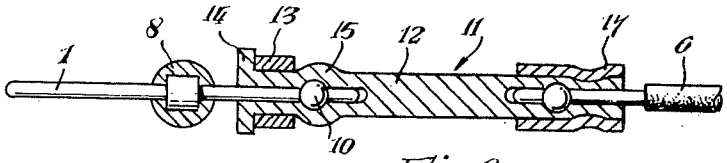
FIG. 9 shows the connection of FIG. 8 after recovery of the recoverable member.

FIG. 9 shows the final connection made upon warming above the transition temperature. The ring 13 has shrunk to its original size and, in doing so, has deformed the tines 15 of the connector 11 so that a secure connection is made about the bulge 10. Because the ring 13 shrinks behind the protuberance 10 (i.e. remote from the end of the pin) it will again be deformed when the connector 11 is cooled to the low temperature form and pulled away from the pin or socket 1. The deformable member 12 may, for this purpose, be provided with an annular groove or similar means for co-operating with the jaws of a hand tool, e.g. pliers, provided for pulling the connector 11 away from the pin or socket 1.

The present invention has been described with particular reference to the making of connections with hermetically sealed components. However, it will be appreciated that it will find use in many other applications, especially those in which the objects to be connected are, by virtue of close packing, virtually inaccessible for the purposes of conventional connection methods, such as soldering.

I claim:

1. A reusable connector comprising a first member, at least part of which is non-resilient and deformable, a second member made from a memory metal capable of reversing between a martensitic state and an austenitic state, and a third, object member adapted to be engaged with said first member to form a connection, said object member having a portion adapted to deform said first and second members when the memory metal is in its martensite state upon engagement of the object member with or its withdrawal from said first member, the arrangement of said first and second members being such that when the object member is engaged with the first member to deform said first and second members, and the memory metal warmed above the temperature which it becomes austenitic, recovery of the second member towards its original configuration forces the deformable portion of said first member into secure engagement with said object member to complete the connection.

2. A reusable connector according to claim 1 wherein said object member is adapted to be inserted into said first member.

3. A connector according to claim 2 wherein the first connector member comprises a longitudinally slotted tubular portion having a plurality of tines, the tines being substantially non-resilient and deformable.

4. A connector according to claim 3 wherein the recoverable member is a band positioned around said tines.

5. A connector according to claim 4 wherein the band is a continuous ring.

6. A connector according to claim 4 wherein the first member is provided with means for positioning the heat recoverable member with respect to the first member.

7. A connector according to claim 6 wherein the positioning means comprises a peripheral shoulder.

8. A connector according to claim 1 wherein the memory metal is an alloy that becomes martensitic below about −40° C.

9. A connector according to calim 8 wherein the martensitic transformation occurs below about −75° C.

10. A connector according to claim 1 wherein the memory metal is an alloy containing approximately equiatomic portions of titanium and nickel.

* * * * *